US012715670B2

(12) United States Patent
Steele

(10) Patent No.: US 12,715,670 B2
(45) **Date of Patent: *Aug. 25, 2026**

(54) PACKAGE HAVING A SPOUT RESERVOIR/RETAINING FEATURE

(71) Applicant: Mark Steele, New Prague, MN (US)

(72) Inventor: Mark Steele, New Prague, MN (US)

(73) Assignee: VALVPAK LLC, New Prague, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/978,334

(22) Filed: Nov. 1, 2022

(65) Prior Publication Data

US 2023/0056802 A1 Feb. 23, 2023

Related U.S. Application Data

(63) Continuation of application No. 16/336,512, filed as application No. PCT/US2017/057760 on Oct. 21, 2017, now Pat. No. 11,505,383.

(60) Provisional application No. 62/411,138, filed on Oct. 21, 2016.

(51) Int. Cl.

| | |
|---|---|
| ***B65D 75/58*** | (2006.01) |
| ***B65D 33/18*** | (2006.01) |
| *B65D 75/00* | (2006.01) |

(52) U.S. Cl.

CPC ..... *B65D 75/5866* (2013.01); *B65D 33/18* (2013.01); *B65D 75/008* (2013.01); *B65D 75/5822* (2013.01); *B65D 2313/02* (2013.01); *B65D 2575/58* (2013.01)

(58) Field of Classification Search

CPC ..... B65D 75/008; B65D 75/5866; B65D 75/5811; B65D 75/5822; B65D 75/566; B65D 75/30; B65D 2313/02; B65D 33/18; B65D 2575/58; B65D 2575/586

USPC .... 222/95, 107, 105, 528, 530, 541.9, 541.6

See application file for complete search history.

(56) References Cited

U.S. PATENT DOCUMENTS

| | | | | |
|---|---|---|---|---|
| 2,665,033 A | | 1/1954 | Robertson | |
| 3,217,934 A | * | 11/1965 | Schneider | B65D 75/52 383/88 |
| 3,224,640 A | * | 12/1965 | Schneider | B65D 31/12 383/88 |
| 3,278,085 A | * | 10/1966 | Brown | B65D 75/5811 222/530 |

(Continued)

FOREIGN PATENT DOCUMENTS

| | | |
|---|---|---|
| DE | 9017419 | 3/1991 |
| JP | 1986-107741 U | 7/1986 |

(Continued)

OTHER PUBLICATIONS

International Search Report for PCT/US2017/0057760 issued Feb. 2, 2018.

(Continued)

*Primary Examiner* — Charles P. Cheyney

(74) *Attorney, Agent, or Firm* — Skaar Ulbrich Macari, P.A.

(57) ABSTRACT

A package designed to prevent the leakage of its contents and to capture any leaked contents within a package reservoir, while permitting the package to be sealed for later access to the contents of the package.

19 Claims, 13 Drawing Sheets

(56) References Cited

U.S. PATENT DOCUMENTS

| | | | | |
|---|---|---|---|---|
| 3,642,189 | A * | 2/1972 | Widenback | B65D 33/02 383/88 |
| 3,815,810 | A | 6/1974 | Wellman | |
| 4,163,509 | A | 8/1979 | Amneus | |
| 4,830,205 | A * | 5/1989 | Hammond | A61J 9/008 215/11.1 |
| 5,199,602 | A * | 4/1993 | Drew | B65D 33/243 222/530 |
| 5,228,782 | A * | 7/1993 | Imer | B65D 75/5822 383/88 |
| 5,547,284 | A * | 8/1996 | Imer | B65D 75/5866 383/105 |
| 5,863,131 | A * | 1/1999 | Nakamura | B65D 75/5883 383/906 |
| 6,446,847 | B1 * | 9/2002 | Huffer | B65D 75/5866 222/541.9 |
| 7,537,387 | B2 * | 5/2009 | Spork | B65D 75/5866 383/88 |
| 9,376,247 | B2 * | 6/2016 | Dodd | B65D 75/5811 |
| 2008/0056623 | A1 * | 3/2008 | Shubilla | B65D 75/5811 383/88 |
| 2011/0075954 | A1 | 3/2011 | Kumar et al. | |
| 2014/0053945 | A1 | 2/2014 | Albritton | |
| 2015/0197379 | A1 | 7/2015 | Otsuka et al. | |
| 2016/0059995 | A1 | 3/2016 | James | |

FOREIGN PATENT DOCUMENTS

| | | | |
|---|---|---|---|
| JP | 2012-017141 | A | 1/2012 |
| JP | 2016011132 | | 1/2016 |
| JP | 2016-108011 | A | 6/2016 |
| JP | 2016-132483 | A | 7/2016 |
| WO | A2009090930 | | 7/2009 |
| WO | 2014061822 | | 4/2014 |
| WO | A2016164185 | | 10/2016 |
| WO | 2018075992 | | 4/2018 |

OTHER PUBLICATIONS

Supplementary European Search Report for EP 17863244 on Apr. 8, 2020.

* cited by examiner

Spout tucks through and back to front
22
36b
26
10
38
38
36a
26
26
Spout tucks through to back
This area can all be sealed
35
14

Spout tucks through to back
spout starts on front
22
10
36b
36a
34
24
Product Flow
Top seal removed
26

10
26
14
26

Spout tucks through to back
34
40a
40b
22
16
26
35
This area can all be sealed

10
Single slit through all panels
34
spout starts on front
22
16
40a
24
Top seal removed
Product Flow
26

14
26
12

22
16
34
6c
6c
10
44a
26
44b
35
Product Flow 22
16
10
34
44b
26
44a
Product Flow

PACKAGE HAVING A SPOUT RESERVOIR/RETAINING FEATURE

PRIORITY

This application is a Continuation of U.S. application Ser. No. 16/336,512, filed on Mar. 26, 2019, which is a National Phase Application of PCT International Application No.: PCT/US2017/057760, filed on Oct. 21, 2017, which claims priority under 35 U.S.C. 119 (e) of U.S. provisional application Ser. No. 62/411,138, filed on Oct. 21, 2016, the contents of which is hereby incorporated by reference in its entirety and for all purposes.

FIELD OF THE INVENTION

The present invention relates generally to flexible packaging and, more particularly, to packages, and methods for forming and using packages, having a drip resistant securing feature.

BACKGROUND OF THE INVENTION

Flexible packages are used for containing a wide variety of items, both solid and liquid, such as beverages, lawn products and food products. More and more packages, including flexible packages, are being used for the containment and or dispensing of food, liquids or medical products.

More and more focus is being directed to providing products designed to be easier for the adults in the household to use, but may contain items or materials that are messy or dangerous for users to come into contact with. One example of this is flexible packaging containing laundry detergent or cleaning solutions. Other liquids having higher viscosity (e.g., honey, lotions, etc.) can be messy when they leak from packages.

The consumer opens the pouch or packaging to access the contents to use or dispense. Any contents left in the pouch can have a tendency to drip or leak, exposing the user to the potentially messy or harmful contents. There is a need in the industry for a pouch or package that can be opened by a user and then operated in a fashion that prevents the contents from dripping or leaking out of the pouch.

SUMMARY OF THE INVENTION

The present invention addresses certain problems facing packages and the packaging industry. Embodiments of the present invention are directed to a flexible package designed to make it more resistant to dripping or leaking after opening.

The package or pouch of the present invention can include an intermediate seam that divides the packaging into a package interior and a reservoir or containment portion. A portion of the intermediate seam can have a slit or can be otherwise divided to form a spout that is used to pour out the contents of the package. The reservoir or containment portion may include one or more slits or openings that are sized and shaped to receive a free end of the spout portion. The reservoir or containment portion can serve to selectively retain the folded spout and/or to ensure that any contents that may remain in the spout portion, or that may leak out of the packaging, would then be captured in the reservoir.

The spout may include one or more closure mechanisms to allow for the automatic or selective closure of the spout. The closure mechanism may include a pressure or fluid lock, a zipper, valve, adhesives, and the like.

The device of the present invention may also include one or more attachment devices designed to permit the attachment of the spout to another portion of the packaging. The attachment devices may include hook and loop fasteners (e.g., Velcro®), snaps, reusable adhesives, and the like. The slit in the reservoir and the attachment devices permit the folding over of the spout to create a fold or kink that assists in restricting the flow of fluid out of the spout.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1B:
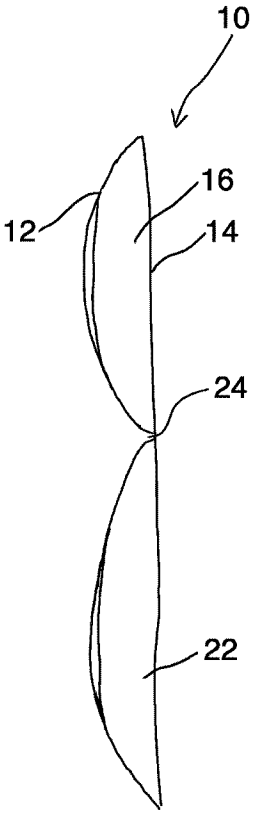
FIG. 1*b* shows a top view of the package of FIG. 1*a*, in accordance with embodiments of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims. For illustrative purposes, cross-hatching, dashing or shading in the figures is provided to demonstrate sealed portions and/or integrated regions or devices for the package.

DETAILED DESCRIPTION OF THE INVENTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings are illustrated only for ease of understanding, but not to limit the actual scale.

References to "top," "bottom," "front," "side," "back" and the like are for illustrative purposes only and are not meant to limit the scope of the disclosed invention.

Referring generally to FIGS. 1*a*-13*c*, a package 10 of the present invention can comprise a front panel portion 12 and a back panel portion 14, defining an interior compartment 16 accessible through an access opening 15. One or more of the package portions can be constructed of a flexible material, a rigid material, a semi-rigid material, and the like. The front and back panel portions 12, 14 can be formed from the shaping and sealing of a single web member or material, or through the sealing or joining of one or more separate web members or materials. One or more of the portions of the package 10 may be gusseted. Placing a gusset on a bottom panel 18 also provides the product with the ability to stand up on its own. Other panels, such as a side panel, could be gusseted as well.

The joining and/or shaping of the panels generally define the inner cavity or interior 16 having an adjustable internal volumetric capacity. The interior 16 is capable of storing, transporting and/or dispensing product or other objects and material therein. The panel portions are often referred to as webs, films, or layers.

Figure 1A:
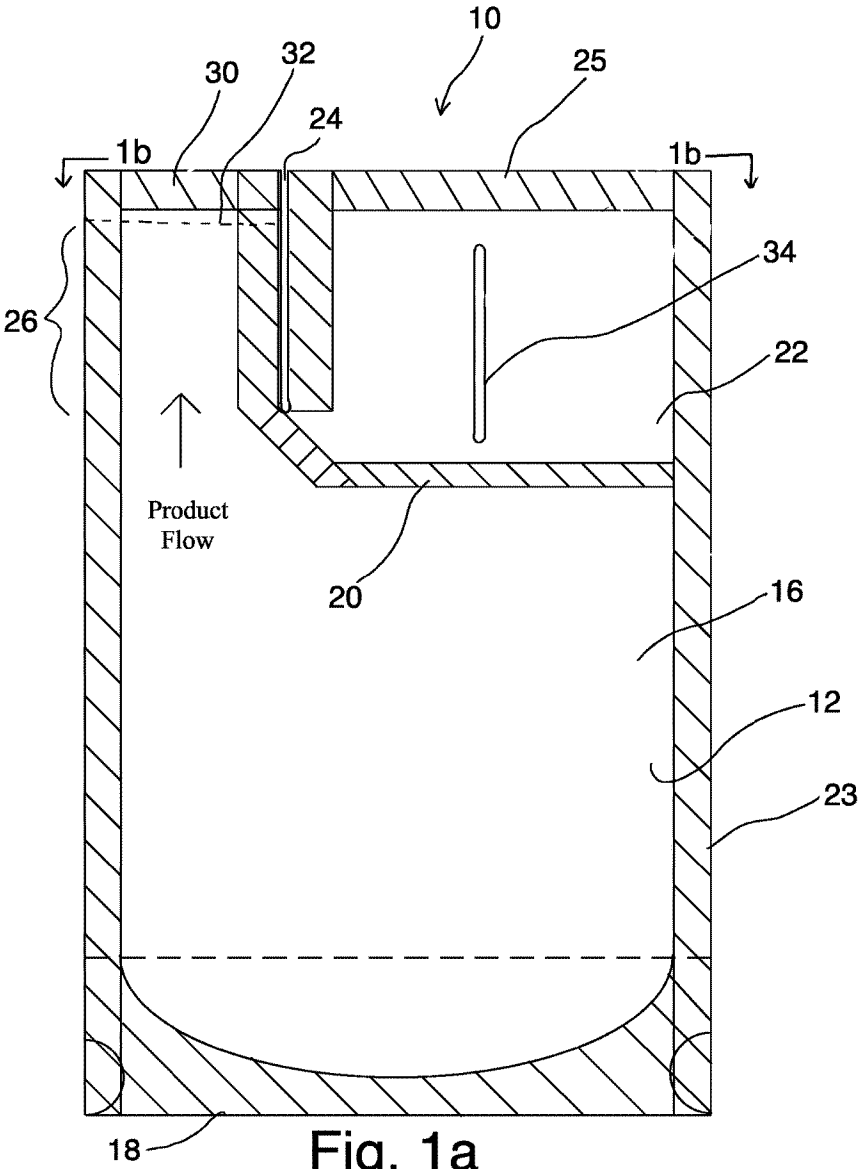
FIG. 1*a* shows a package having a pliable spout feature and reservoir or containment portion, in accordance with embodiments of the present invention.

The package 10 may also include an intermediate seal 20 that defines the interior 16 and a reservoir or containment pocket 22. As illustrated in FIG. 1*a*, the intermediate seal 20 may extend between a side seal 23 of the package 10 and a top seal 25 of the package. The intermediate seal 20 may extend between any seals of the package 10. The seal 20 may take on various shapes, sizes, and construts. A cut, gap, or separation 24 may be provided in a portion of the intermediate seal 20, or along a portion of the package, to form a dispensing end or spout portion 26. The contents disposed in the interior 16 of the package 10 can flow or travel out of a spout portion 26, via the access opening 15. In another embodiment of the present invention, the reservoir, retention, or containment portion 22 may be formed by adding one or more layers of material (e.g., package 10 or one or more separate layers or materials) to the front panel portion 12 or the back panel portion 14.

The spout portion 26 may include a closure seal 30 that prevents the contents of the package 10 from escaping the package 10 during transportation and handling. The package 10 may include a closure seal 30 removal feature or mechanism 32, such as perforations (e.g., laser or machine created), tears, slits, notches, and the like, that permits a user to easily remove the closure seal to access the contents of the package 10. Alternatively, a user may utilize scissors or other cutting means or devices to remove the closure seal 30.

Continuing with FIG. 1*a*, the front panel portion 12 of the reservoir 22 can include a slit or opening 34 that may extend a distance between the top seal 25 and the intermediate seal 20 and generally parallel to a longitudinal axis of the spout portion 26. The slit 34 may provide access to an interior of the reservoir 22. The slit 34 may have any shape and size and may be oriented in any number of directions to facilitate the retention features disclosed herein. In the example embodiment of FIGS. 5*a*-5*c*, for example, the slit 34 is angularly oriented to a long axis of the spout portion 26.

Figures 2A, 2B, 2C, 2D:
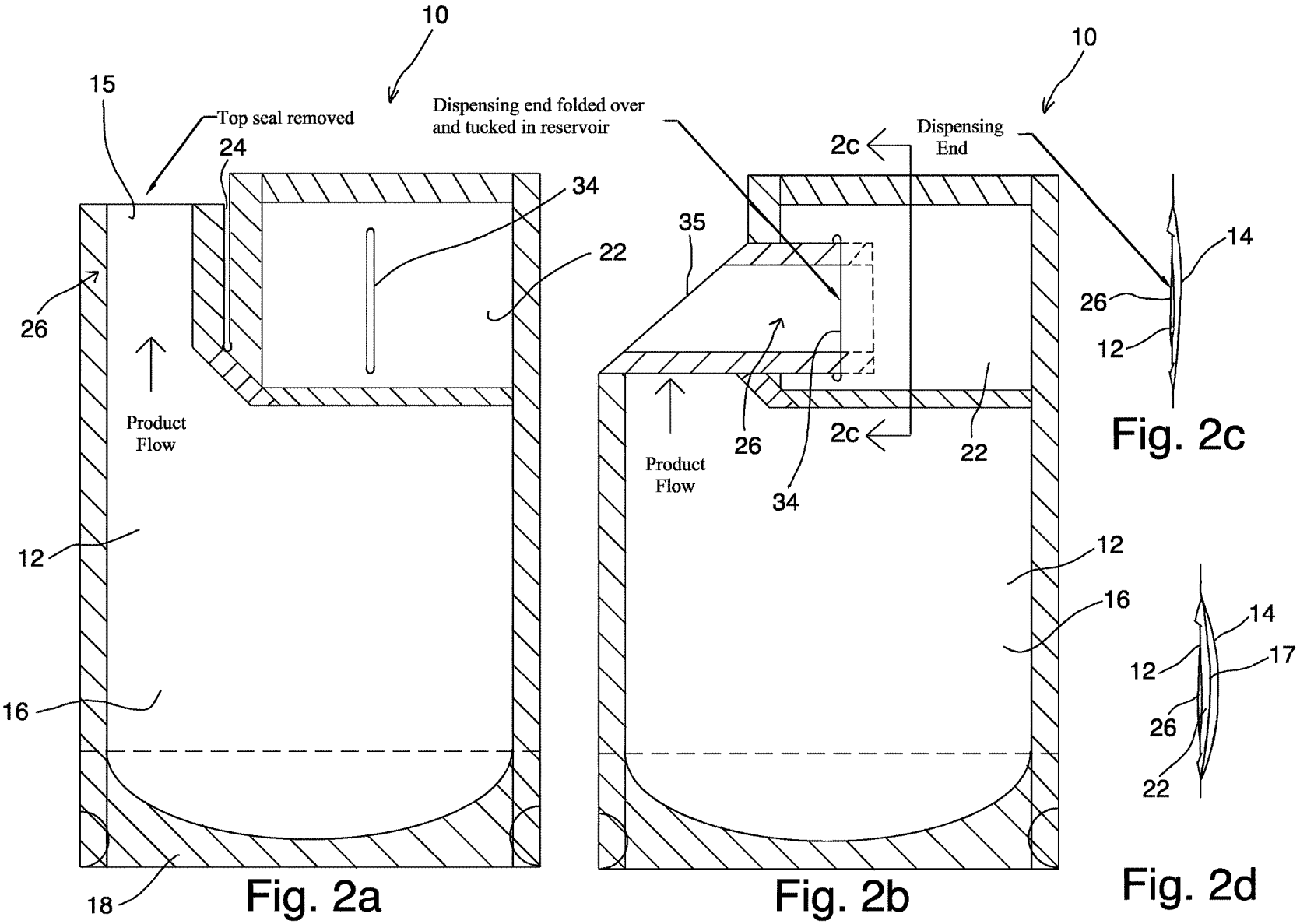
FIG. 2*a* shows a package having a pliable spout feature with a seal removed, in accordance with embodiments of the present invention.
FIG. 2*b* shows a package having a pliable spout feature positioned in a reservoir or containment portion, in accordance with embodiments of the present invention.
FIG. 2*c* shows a cross section of FIG. 2*b* along line 2*c*-2*c*, in accordance with embodiments of the present invention.
FIG. 2*d* shows a cross section of an example embodiment having a reservoir or containment portion made from one or more panels of material formed or added to the packaging, in accordance with embodiments of the present invention.

As illustrated in FIGS. 2*a*-2*d*, once the closure seal 30 has been removed from the spout portion 26 and the contents or a portion of the contents are removed or forced out of the package, the spout portion 26 can be folded over or kinked and tucked into the slit 34, as particularly illustrated in FIG. 2*b*. The opening or end of the spout portion 26 is positioned in the reservoir 22. In this configuration, any remaining contents in the interior 16 of the package 10 will be restricted from flowing past the fold, kink or bend 35. Any contents that may get past the fold, or any content residue that remains in the spout portion 26 after folding, may then leak into or be contained by the reservoir 22. This prevents the contents from leaking out onto the packaging, or the surrounding environment, and potentially causing a mess or exposure to a user. As such, the reservoir or containment portion 22 can serve to selectively retain the folded spout and/or to ensure that any contents that may remain in the spout portion, or that may leak out of the packaging, would then be captured in the reservoir.

In another embodiment of the present invention, as illustrated in FIG. 2*d*, the reservoir 22 may be formed by adding one or more layers of material 17 (e.g., package 10 material, or a separate film or material) to the front panel portion 12 or the back panel portion 14.

The interior of the reservoir 22 may include a one-way valve or like containment feature operatively disposed therein to prevent any contents or residue from the spout portion 26 that leaks into the reservoir 22 from leaking back out. In another embodiment, the one-way valve may be operatively disposed in the intermediate seam 20 connecting the reservoir 22 to the interior 16 of the packaging 10. Any contents that may leak from the spout portion 26 into the reservoir 22 can flow back into the interior 16 of the package 10. The one-way valve prevents the contents of the package 10 from flowing through the one-way valve back into the reservoir 22.

Figures 3A, 3B, 3C:
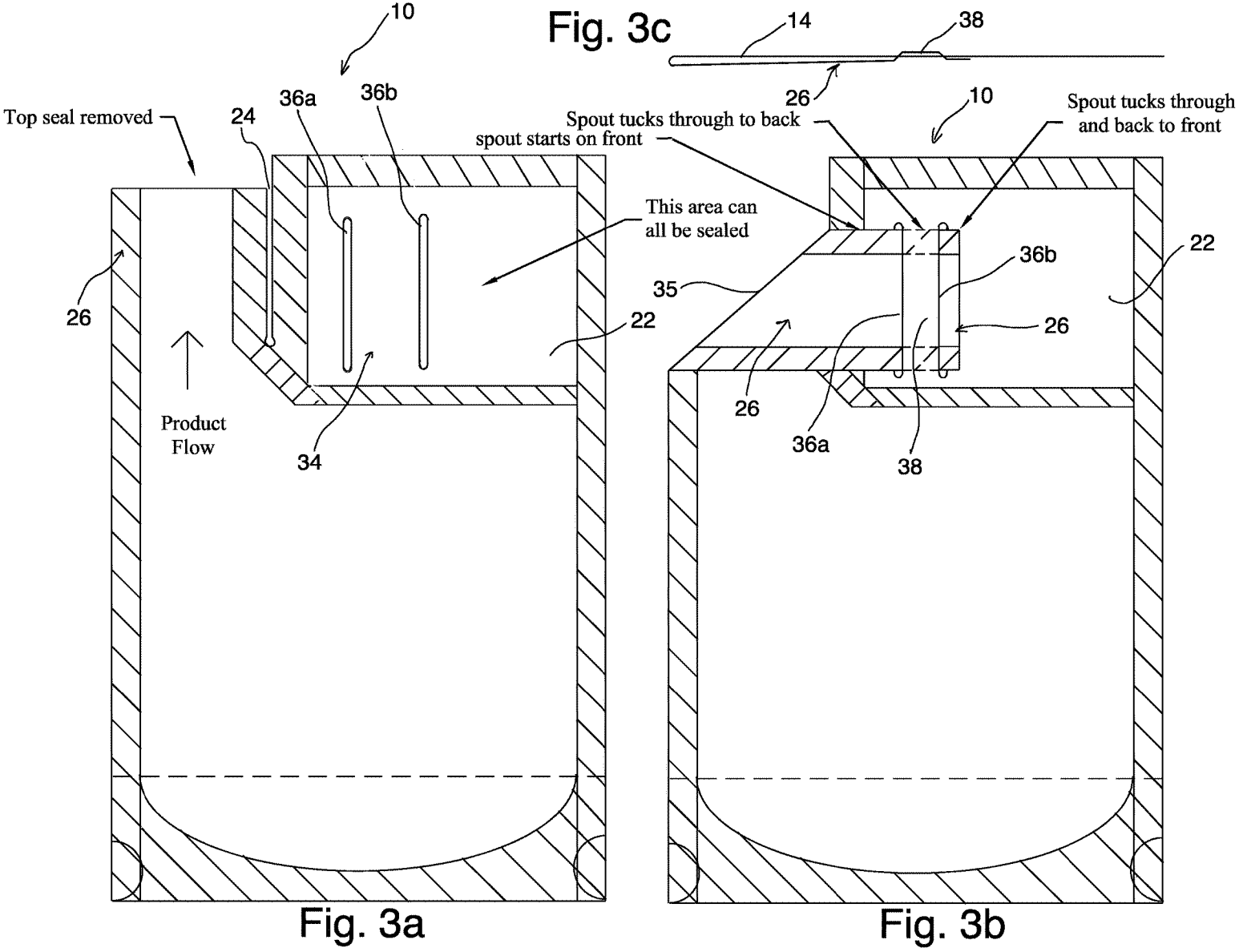
FIG. 3*a* shows a package having a pliable spout feature with a seal removed and a spout retaining feature, in accordance with embodiments of the present invention.
FIG. 3*b* shows a package having a pliable spout feature positioned in a spout retaining feature, in accordance with embodiments of the present invention.
FIG. 3*c* shows a top view of FIG. 3*b*, in accordance with embodiments of the present invention.

In another example embodiment, as illustrated in FIGS. 3*a*-3*c*, the front panel portion 12 of the reservoir or containment area 22 may include two or more slits. In this example embodiment, the spout portion 26 may be folded or bent over and inserted into a first slit 36*a* and then woven or threaded out of a second slit 36*b*. The retaining section 34 of the front panel portion 12 may be formed between the first slit 36*a* and the second slit 36*b* to retain or restrain a free end of the spout portion in order to maintain the fold 35, which restrains the flow of contents out of the spout portion 26. The retaining section can simply be part of the package material, or can include a rigid or semi-rigid member or feature to assist in retaining the spout portion 26, or in applying a degree of pressure to pinch off the end of the spout portion 26. Similar to other example embodiments, the fold 35 and the retaining section 38 work to prevent the flow of the contents from the package 10 and spout portion 26. In some example embodiments, the front panel portion 12 and back panel portion 14 in the region of the containment area 22 may be sealed together or may comprise a single panel.

Figures 4A, 4B, 4C:
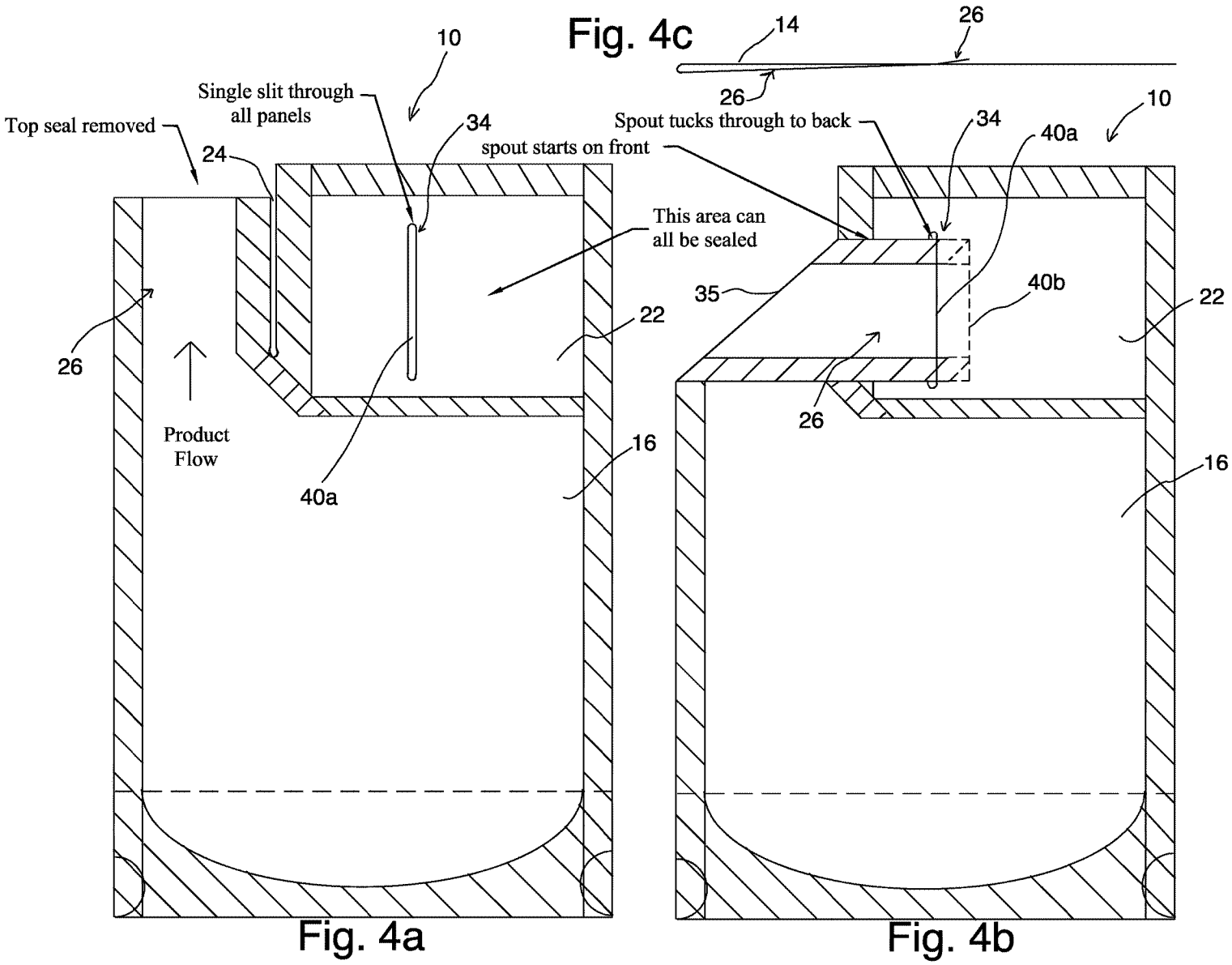
FIG. 4*a* shows a package having a pliable spout feature with a seal removed and a spout retaining feature, in accordance with embodiments of the present invention.
FIG. 4*b* shows a package having a pliable spout feature positioned in a spout retaining feature, in accordance with embodiments of the present invention.
FIG. 4*c* shows a top view of FIG. 4*b*, in accordance with embodiments of the present invention.

Turning to FIGS. 4*a*-4*c*, the reservoir portion 22 may include a first slit 40*a* extending through the first panel portion 12 and a second slit 40*b* extending through the back panel portion 14. The first slit 40*a* and the second slit 40*b* may be in or out of register. In this example embodiment, once the spout portion 26 is folded or bent, a free end of the spout portion 26 can be fed or threaded into the first slit 46*a* and out the second slit 46*b* such that its free end extends away from the back panel portion 14, as illustrated in FIG. 4*c*. The front panel portion 12 and the back panel portion 14 may also comprise a single panel instead of two distinct panels.

Figures 5A, 5B, 5C:
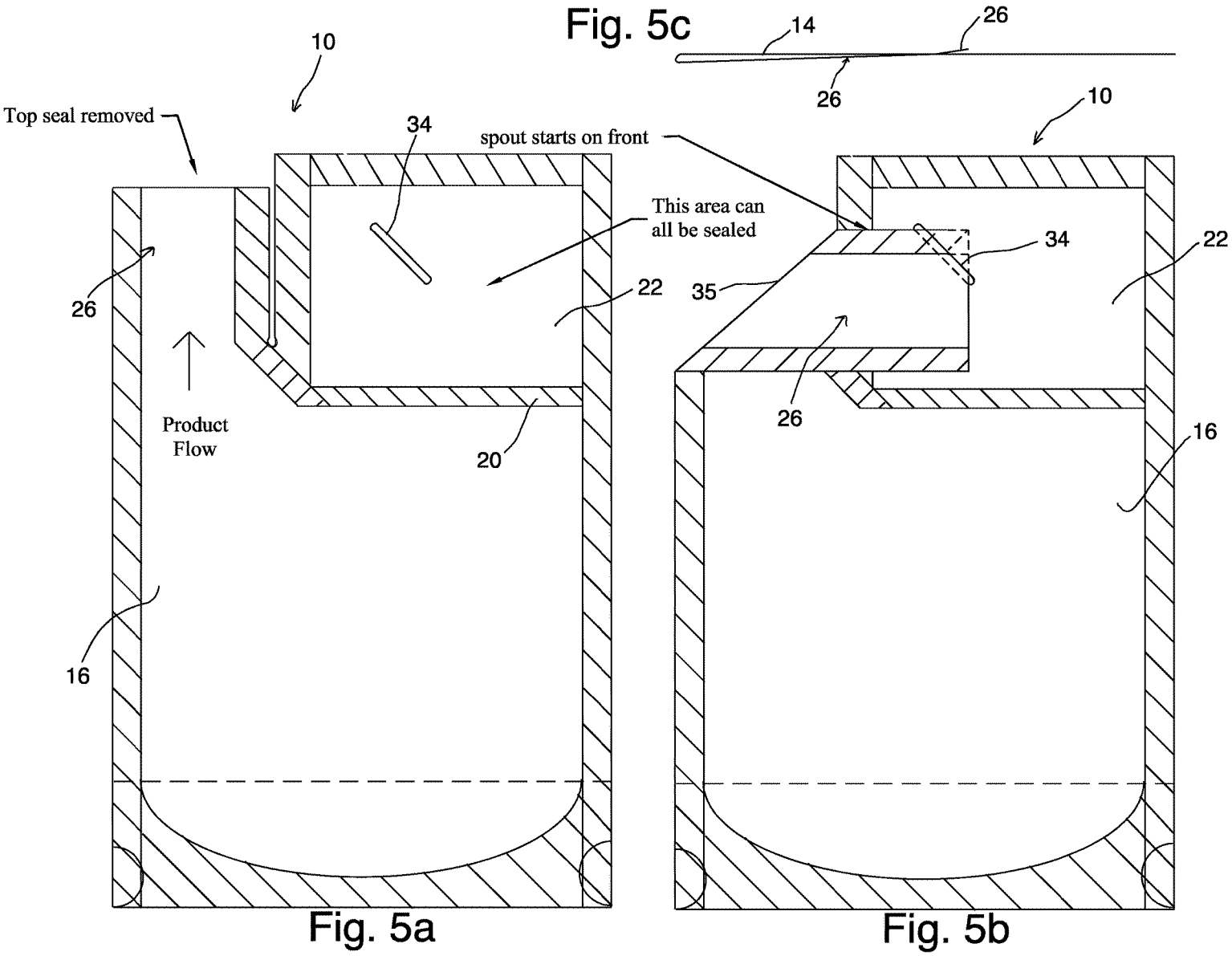
FIG. 5*a* shows a package having a pliable spout feature with a seal removed and a spout retaining feature, in accordance with embodiments of the present invention.
FIG. 5*b* shows a package having a pliable spout feature positioned in a spout retaining feature, in accordance with embodiments of the present invention.
FIG. 5*c* shows a top view of FIG. 5*b*, in accordance with embodiments of the present invention.

As illustrated in FIGS. 5*a*-5*c*, only a limited portion of the spout portion 26 may be fed or inserted into a slit 34 of the reservoir or containment area 22. The slit 34 can be arranged in any orientation relative to a longitudinal axis of the spout portion 26. In this particular exemplary embodiment, the slit 34 is angled relative to a long axis of the spout portion 26 such that only a corner section of the spout portion 26 extends into the slit 34. The corner section may be disposed in the reservoir 22 or may extend through a second slit (not shown) in the back panel portion 14 such that it extends completely through the packaging 10. The entire reservoir or containment area 22 may be sealed such that it does not include a reservoir interior (e.g., sealing the first and second panels 12, 14 together in this area).

Figures 6A, 6B, 6C:
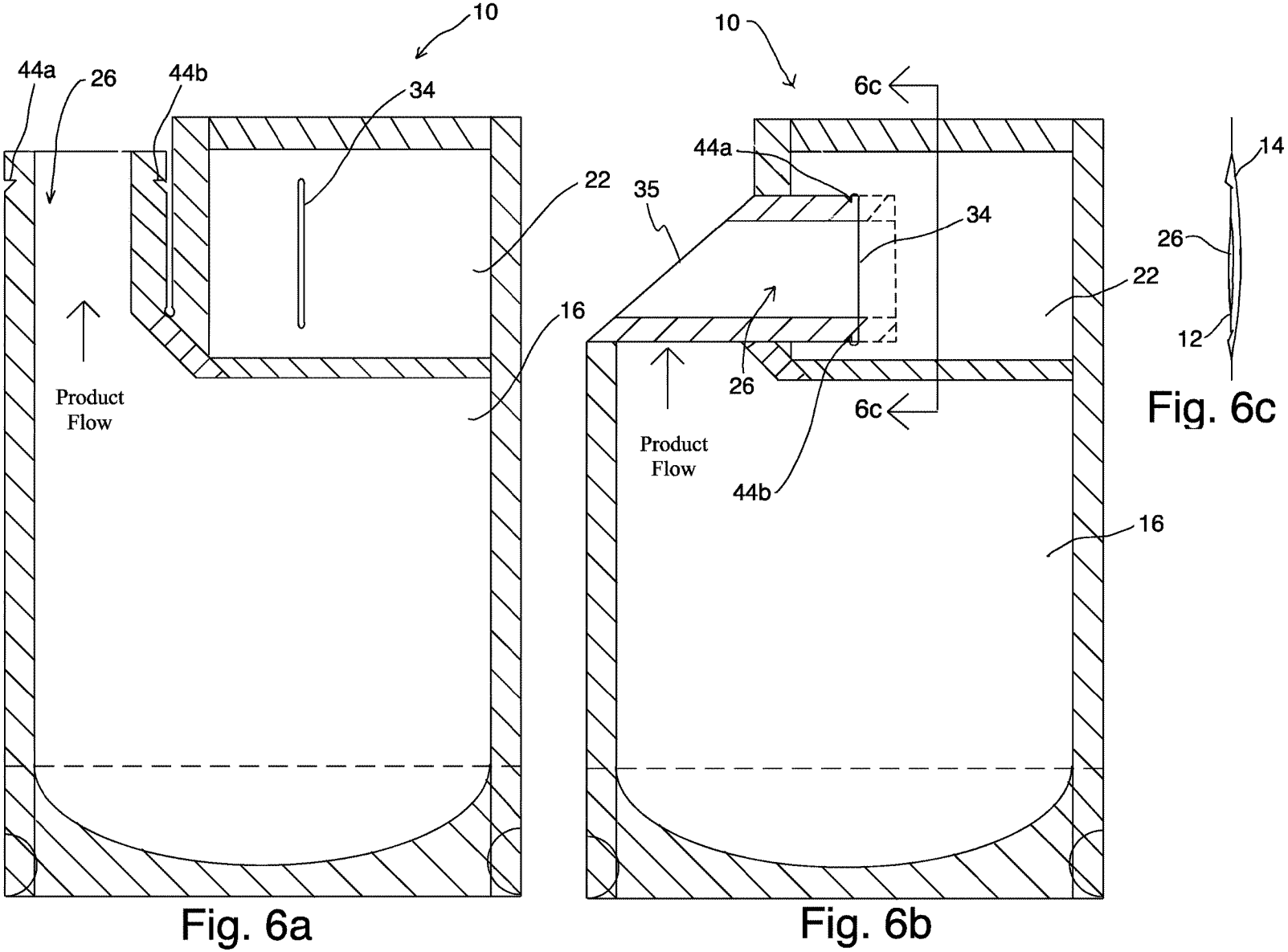
FIG. 6*a* shows a package having a pliable spout feature with a seal removed, a securing feature and a spout retaining feature, in accordance with embodiments of the present invention.
FIG. 6*b* shows a package having a pliable spout feature positioned in a spout retaining feature, in accordance with embodiments of the present invention.
FIG. 6*c* shows a cross section of FIG. 6*b* along line 6*c*-6*c*, in accordance with embodiments of the present invention.

The spout portion 26 may also include one or more securing features formed therein to assist in retaining the spout portion 26 in the reservoir 22 or slit 34. As illustrated in FIGS. 6*a*-6*c*, the spout portion 26 may include one or more notches 44*a* and 44*b* formed into side seams proximate to a free end of the spout portion 26. As illustrated in FIG. 6*b*, the notches 44*a* and 44*b* engage ends of slit 34 when tucked into the reservoir 22. The notches 44*a* and 44*b* assist in restraining rearward movement of the spout portion 26 out of the slit 34. As with other example embodiments, a free end of the spout portion 26 may extend partially or completely through the packaging 10. Clips, members, bars, pins, and the like can be further employed to assist in retaining the free end of the spout portion 26 to the package or the retention area 22.

Referring to FIGS. 7-9*b*, one or more closure mechanisms may be operatively disposed in or on the spout portion 26 to permit selective closure of a throat or opening of the spout portion 26. These closure mechanisms may include various valves, zippers, or like closures, constructs, and structures, and forming methods and can be provided with embodiments of the package 10 of the present invention. For instance, various embodiments of closure and re-closable devices, and formation methods, detailed herein are envisioned for use with, and can incorporate aspects of, those disclosed in U.S. Patent Publication Nos. 2016/0297571, U.S. Pat. Nos. 7,207,717, 7,883,268, and 8,613,547. Accordingly, the above-identified patent disclosures are fully incorporated herein by reference in their entirety.

Figure 7:
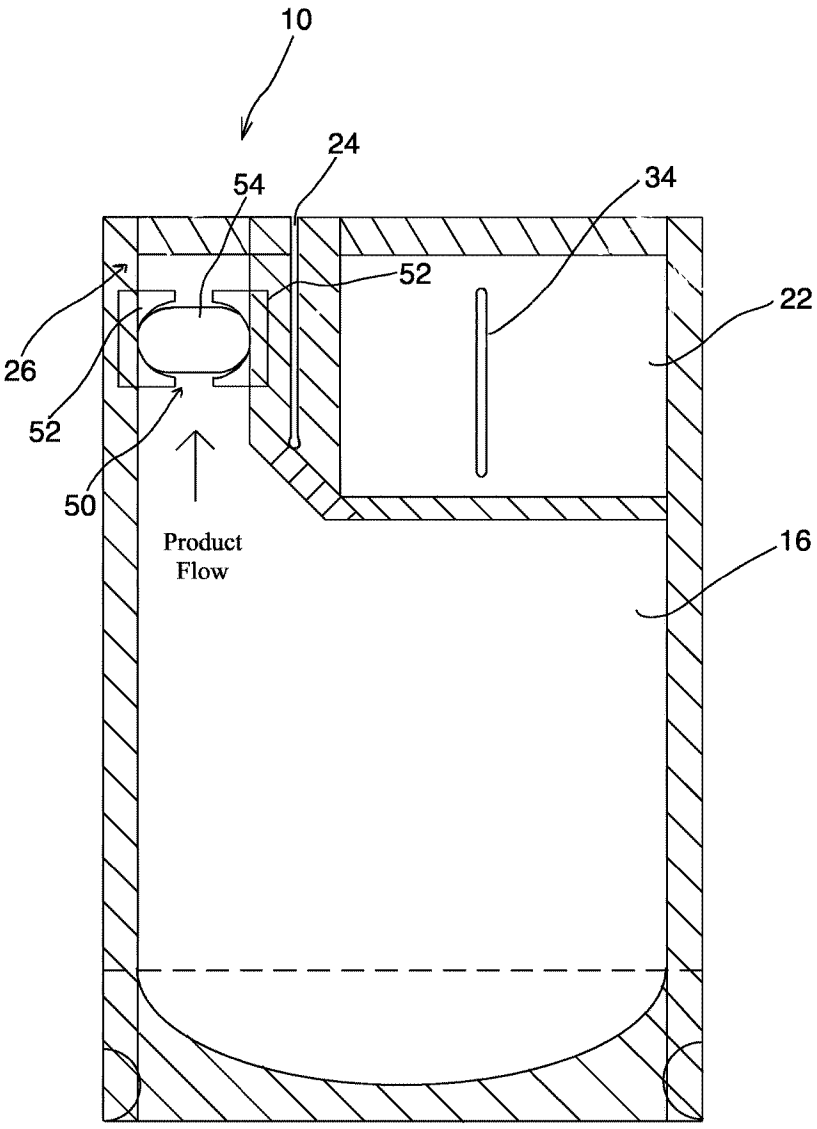
FIG. 7 shows a package having a closure valve mechanism disposed in a pliable spout feature with a seal and a spout retaining feature, in accordance with embodiments of the present invention.
Figures 8A, 8B, 8C:
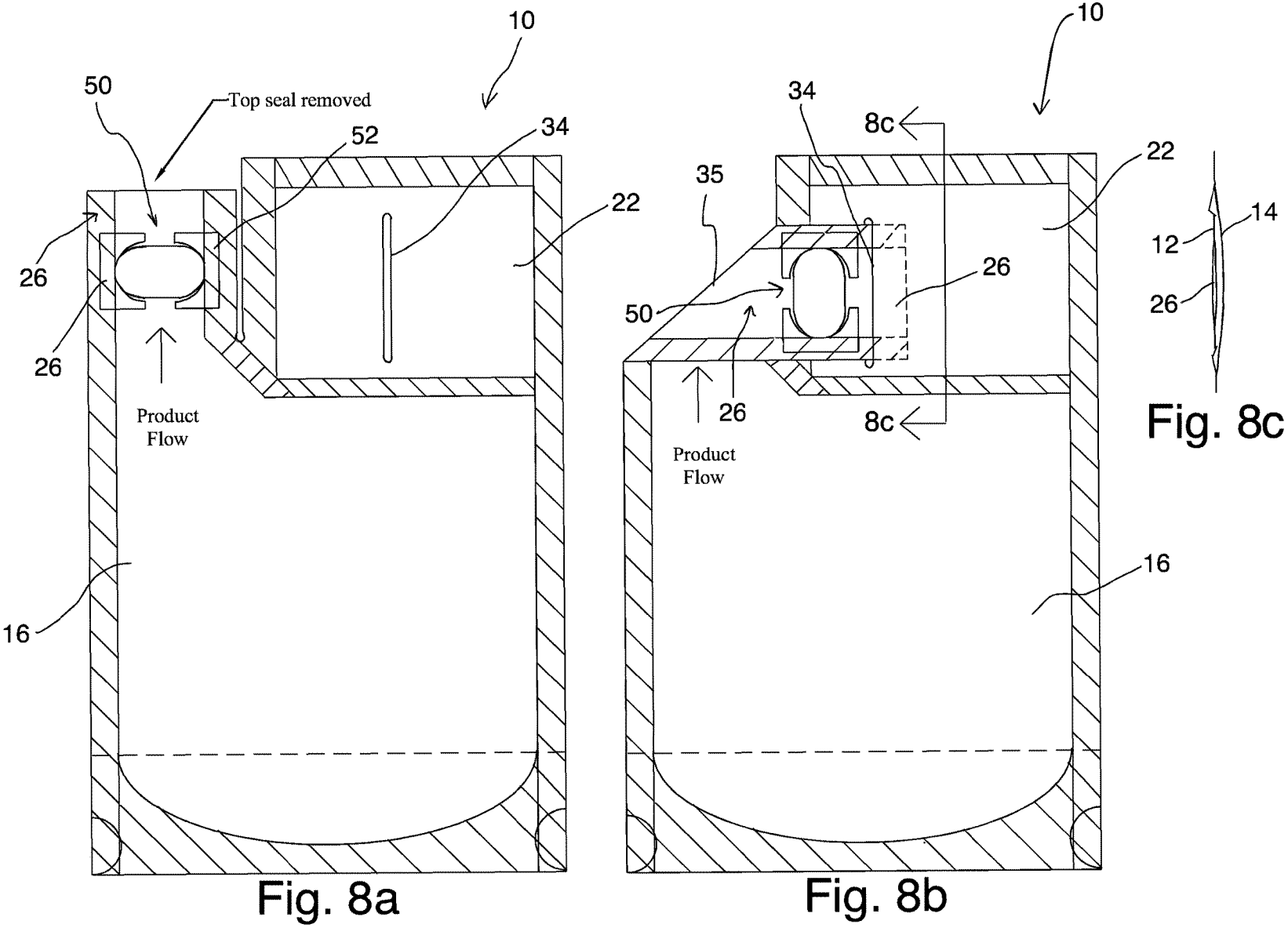
FIG. 8*a* shows a package having a closure valve mechanism disposed in a pliable spout feature with a seal removed and a spout reservoir/retaining feature, in accordance with embodiments of the present invention.
FIG. 8*b* shows a spout and closure valve mechanism positioned in a reservoir containment feature, in accordance with embodiments of the present invention.
FIG. 8*c* shows a cross section view of FIG. 8*b* at line 8*c*-8*c*, in accordance with embodiments of the present invention.

Referring to FIGS. 7-8*c*, packages 10 of the present invention can include one or more valve closures 50, including a bubble-shaped closure, hollow or solid protrusions, extending members, convex-shaped features, shape memory features, or any like structure or feature having a shape and size to provide selective blocking of an access opening of the spout portion 26. Upon application of pressure by the end user to a portion of the package, product from within the inner cavity 16 can be forced out past the closure 50, while remaining within the inner cavity 16 until such pressure is applied (even with movement, tipping, or placing of the package 10 completely upside down). Any of the embodiments described and depicted herein can include the valve closure 50, along or at any portion of the package 10, including any spout or like feature or portion.

The valve closures 50 can be applied to a portion of the front or back panel portions 12 or 14, with end portions 52 extending from the bubble-shaped device for sealing to the portions 12 or 14. An interior 54 of the device 50 can be filled with fluid (e.g., air or liquid), or can be constructed at least in part of a spongy, solid, or shape-memory material. The device 50 may also be attached to a patch of material that can be pre-formed and disposed along any portion of the package 10 to provide the restrictive valve functionality described herein.

In the application of valve closures 50 that include an air pressurized bubble, or other closure valve types such as rubber, that have forgiveness, flexibility, and shape memory (causing them to spring back toward the original shape after squeezing of the package), the sealing and placement system of the present invention is desired. This sealing method allows the panel 14 (or 12) opposing the valve closure 50 to press down against the valve, pinching off any opportunity for the product, or air, to pass by it until selective dispensing is performed (e.g., via applied pressure to a portion of the package 10). Other materials, members, or features can be provided to interface with or engage the closure 50 to facilitate the valve and closure functionality described herein.

Further, with some valves types 50, it is not desirable to actually seal the opposing panel of material into or onto the valve 50 itself, especially if the valve is a more solid material without much, or any, memory or forgiveness. In such applications, the flexible material of the package 10 is relied on to flex away from the valve material 50 to allow the air or contents (e.g., liquid) to pass by the valve material 50 when the package 10 is squeezed or otherwise receives adequate pressure.

As illustrated in FIGS. 8*a* and 8*b*, spout portion 26 having the valve closure 50 may be folded over and a free end inserted into slit 34 as an added measure to prevent contents of the packaging 10 from leaking if an unintended weight or other pressure squeezes the package 10 when not in use. The free end of the spout portion 26 may be retained in the reservoir 22 or may extend completely through the packaging as described in various embodiments.

Figure 9B:
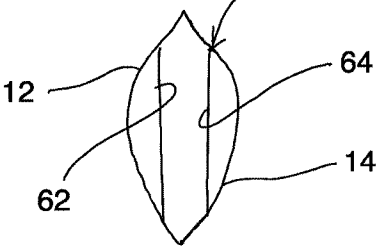
FIG. 9*b* shows a top view of the spout of FIG. 9*a*, in accordance with embodiments of the present invention.
Figure 9A:
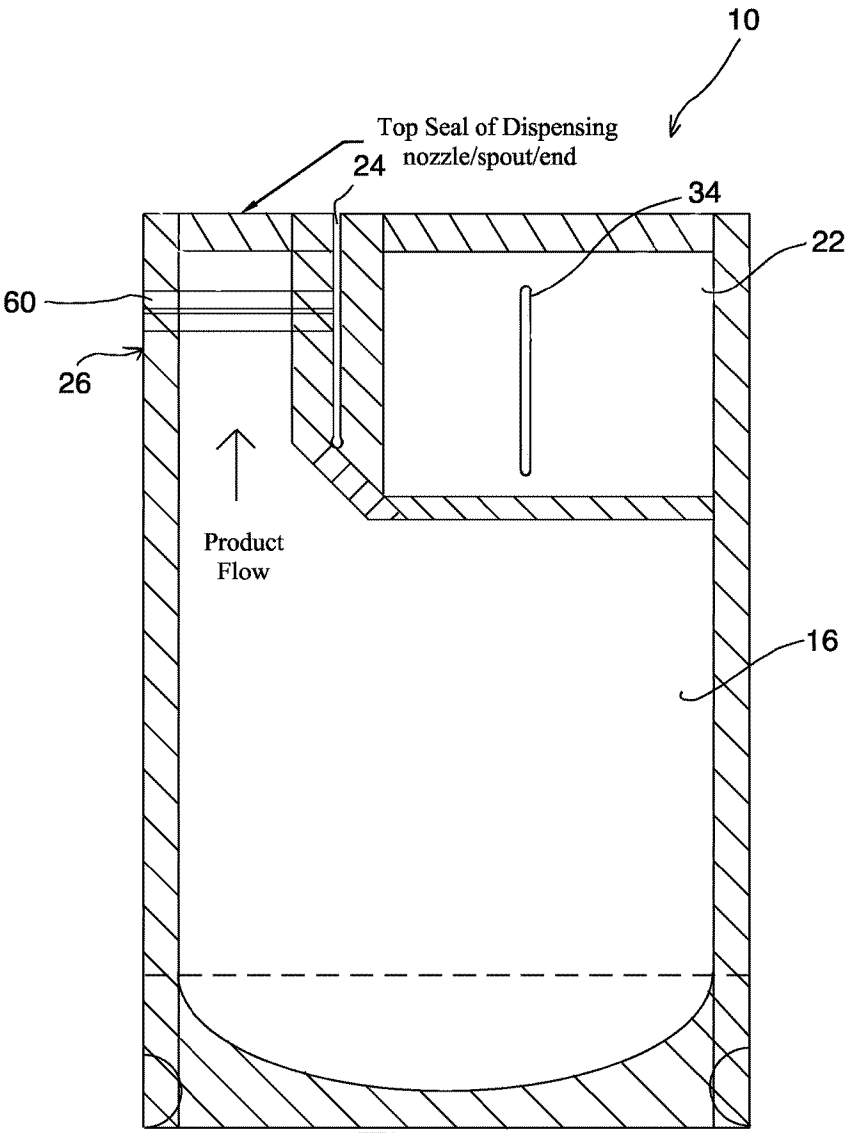
FIG. 9*a* shows a package having a closure mechanism disposed in a pliable spout feature with a top seal removed, in accordance with embodiments of the present invention.

As illustrated in FIGS. 9*a* and 9*b*, the closure mechanism may include a reclosable zipper 60. In certain embodiments, the zipper 60 can include a first portion 62 attached to the inside of the first panel portion 12, and a second portion 64 attached to the inside of the second panel portion 14. As such, the portions 62, 64 are adapted for selective mateability, and opening and closing of the mechanism 60.

Figure 10B:
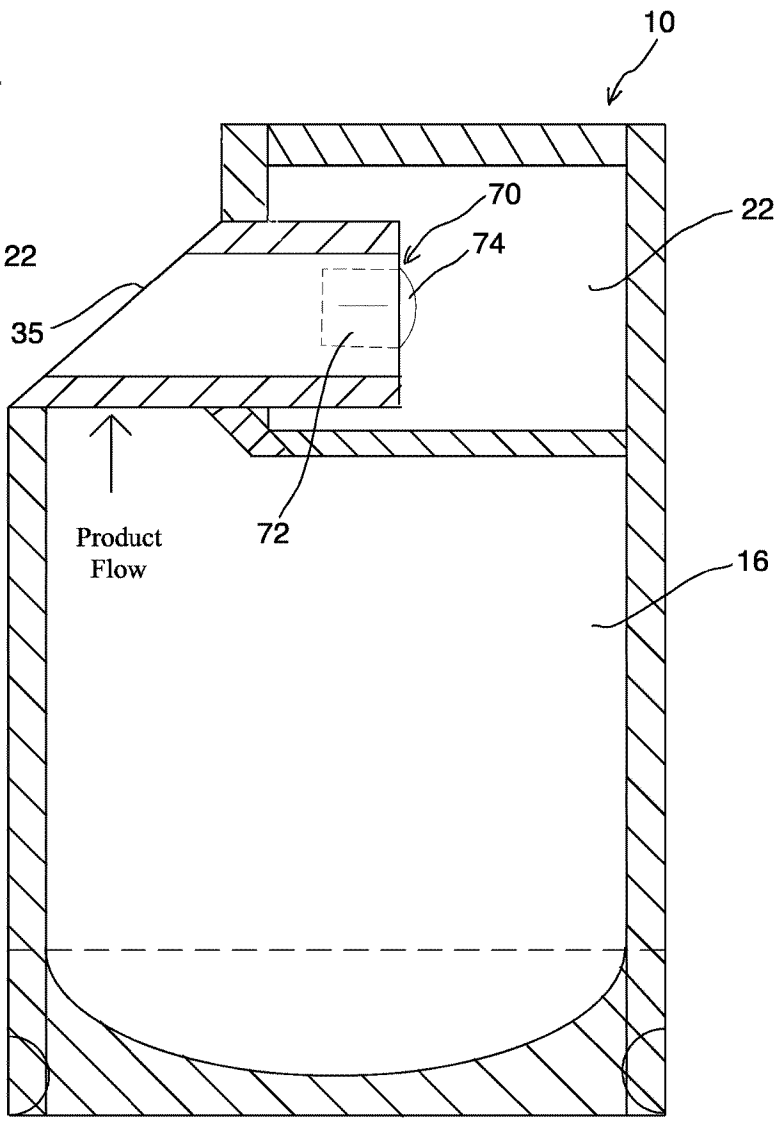
FIG. 10*b* shows a package having a pliable spout feature operatively coupled to a spout retaining feature, in accordance with embodiments of the present invention.
Figure 10A:
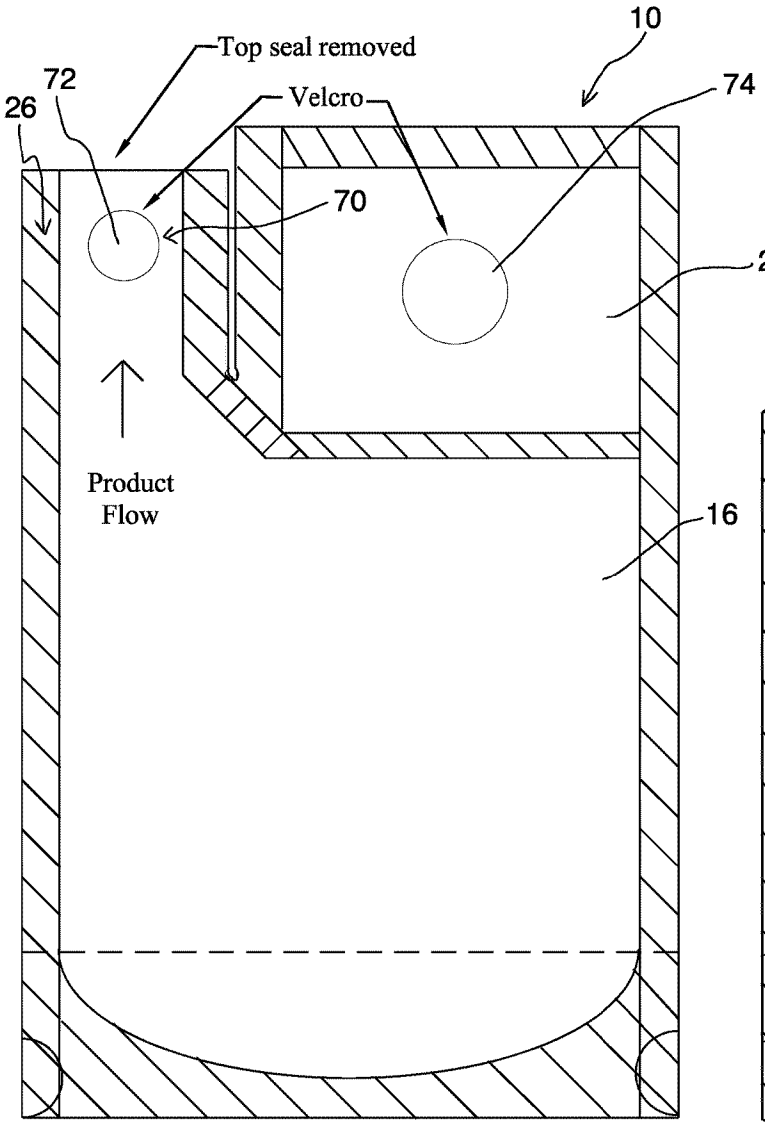
FIG. 10*a* shows a package having a pliable spout feature with a seal removed and a retaining feature, in accordance with embodiments of the present invention.

The packaging 10 may also include one or more attachment devices 70 designed to attach the spout portion 26 to another portion of the packaging 10. The attachment devices 70 may include hook and loop fasteners (e.g., Velcro®), snaps, buttons, clasps, members, adhesives, external zippers, and the like. The attachment devices 70 may include a first attachment portion 72 fixed or disposed on the spout portion 26 and a second attachment portion 74 fixed or disposed on another portion of the packaging 10, such as the rentetion area 22. As illustrated in FIGS. 10*a* and 10*b*, the first attachment portion 74 is disposed on the spout portion 26 while the second attachment portion 74 is disposed on the first panel portion 12 of the retention area 22. When the spout portion 26 is folded over and attached to the second attachment portion 74 the contents of the packaging 10 are restricted from flowing out of the spout portion 26 by the fold 35.

Figure 11B:
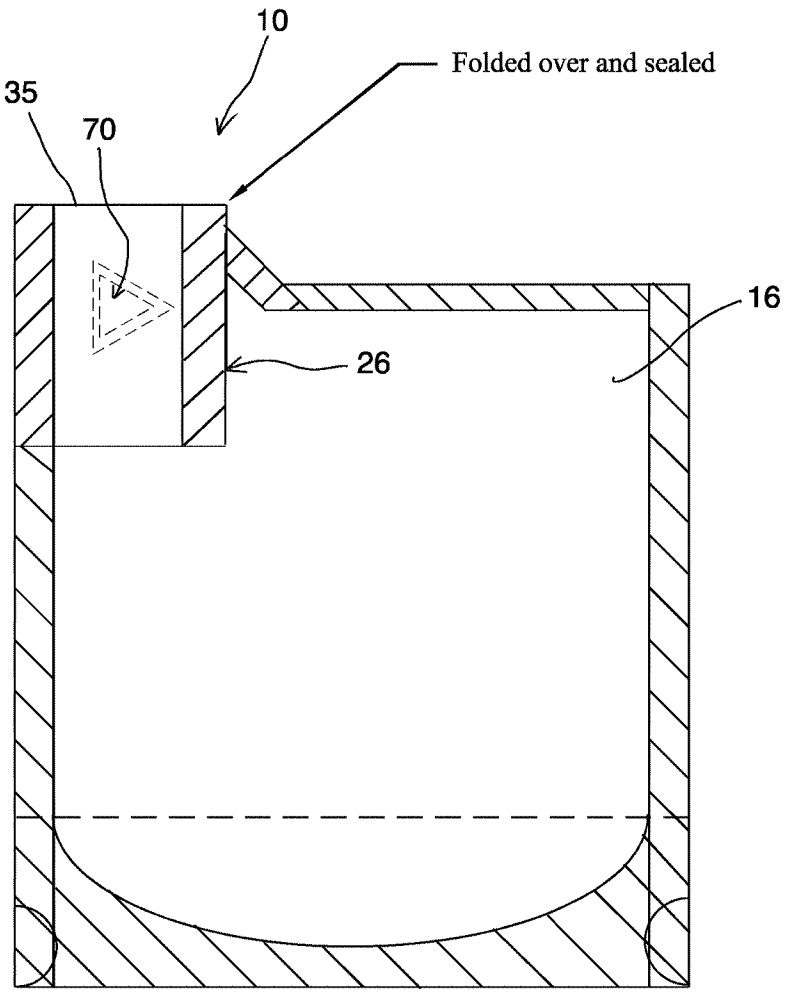
FIG. 11*b* shows a package having a pliable spout feature operatively coupled to a spout retaining feature, in accordance with embodiments of the present invention.
Figure 11A:
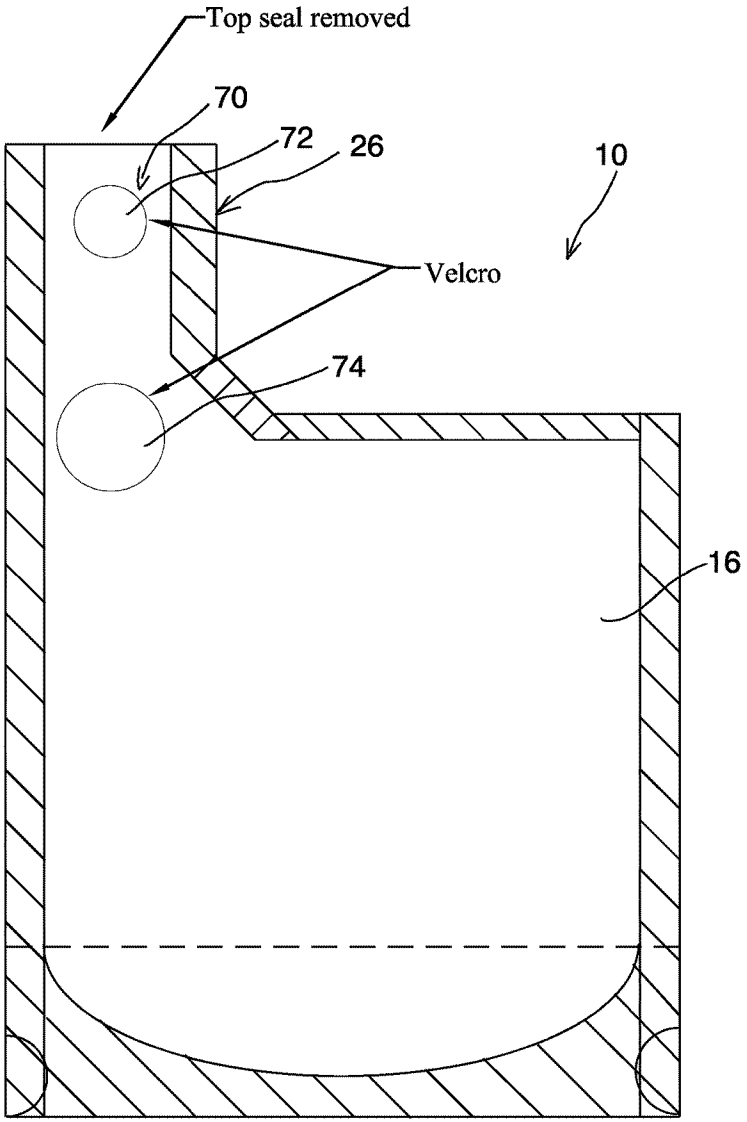
FIG. 11*a* shows a package having a pliable spout feature with a seal removed and a retaining feature, in accordance with embodiments of the present invention.

As illustrated in FIGS. 11*a* and 11*b*, the second attachment portion 72 may be disposed on a portion of the packaging 10 other than area 22. In this instance, area 22 may be eliminated. As can be seen, the spout portion 26 may be folded over to create a fold 35 and the attachment portions 72, 74 are mated together to maintain the fold 35 and prevent the contents from escaping the interior 16 of the packaging 10.

Figures 12A, 12B, 12C:
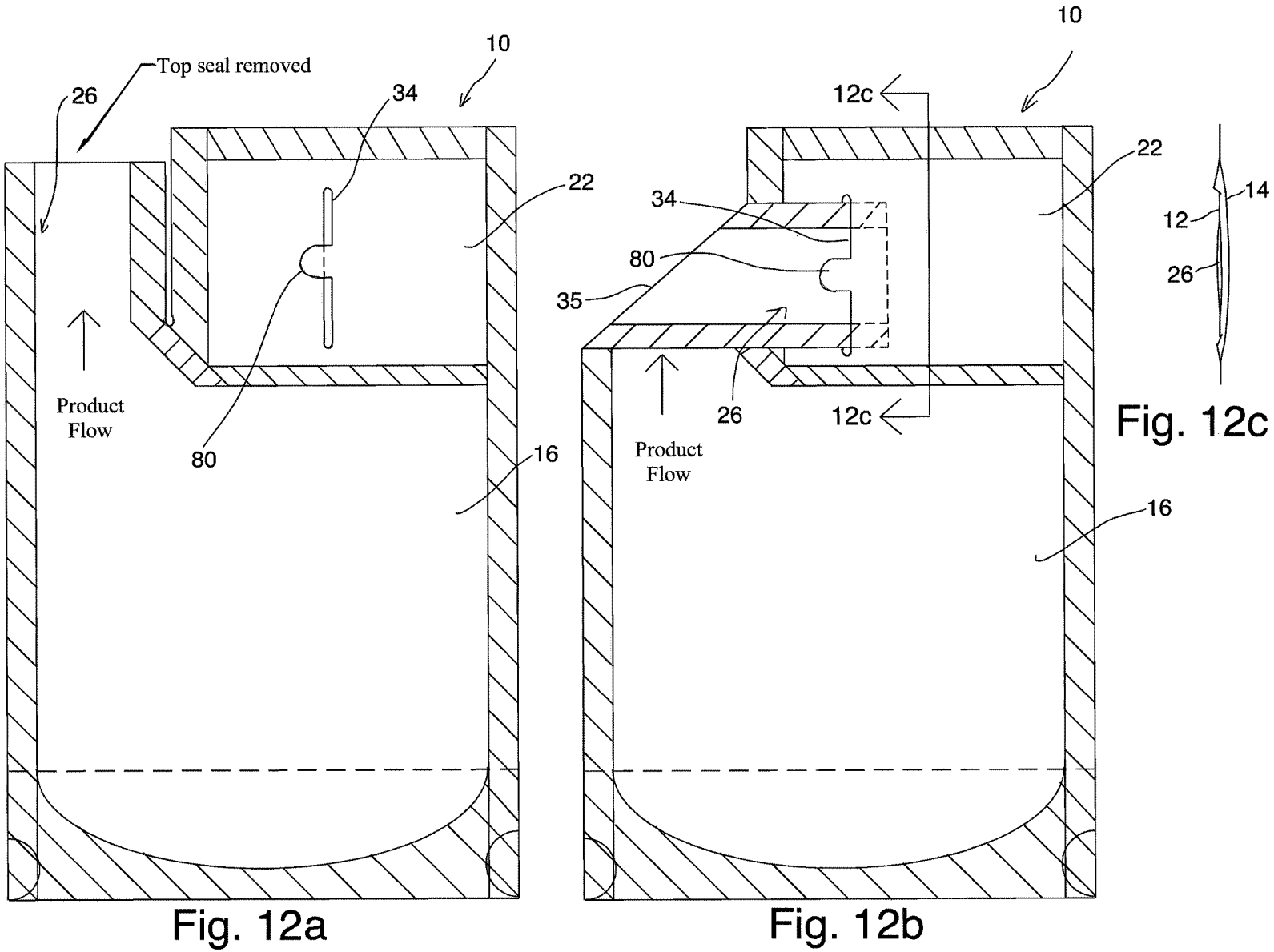
FIG. 12*a* shows a package having a pliable spout feature without a seal and a spout retaining feature with a tab, in accordance with embodiments of the present invention.
FIG. 12*b* shows a package having a pliable spout feature operatively coupled to a spout retaining feature having a tab, in accordance with embodiments of the present invention.
FIG. 12*c* shows a cross section view of FIG. 12*b* along line 12*c*-12*c*, in accordance with embodiments of the present invention.

As illustrated in FIGS. 12*a*-12*c*, a tab, flap, or other gripping member 80 may be disposed on the reservoir or containment area 22 and may be proximate to the slit or opening 34. The tab 80 can assist a user by permitting the user to pull the tab while inserting the spout portion 26 into or through the slit 34 (or used to pull the spout portion 26 out of the slit 34). The tab 80 may be manufactured from the package 10 material and may be formed during the manufacturing process, or the tab 80 may be added separately to the packaging 10.

Figures 13A, 13B, 13C:
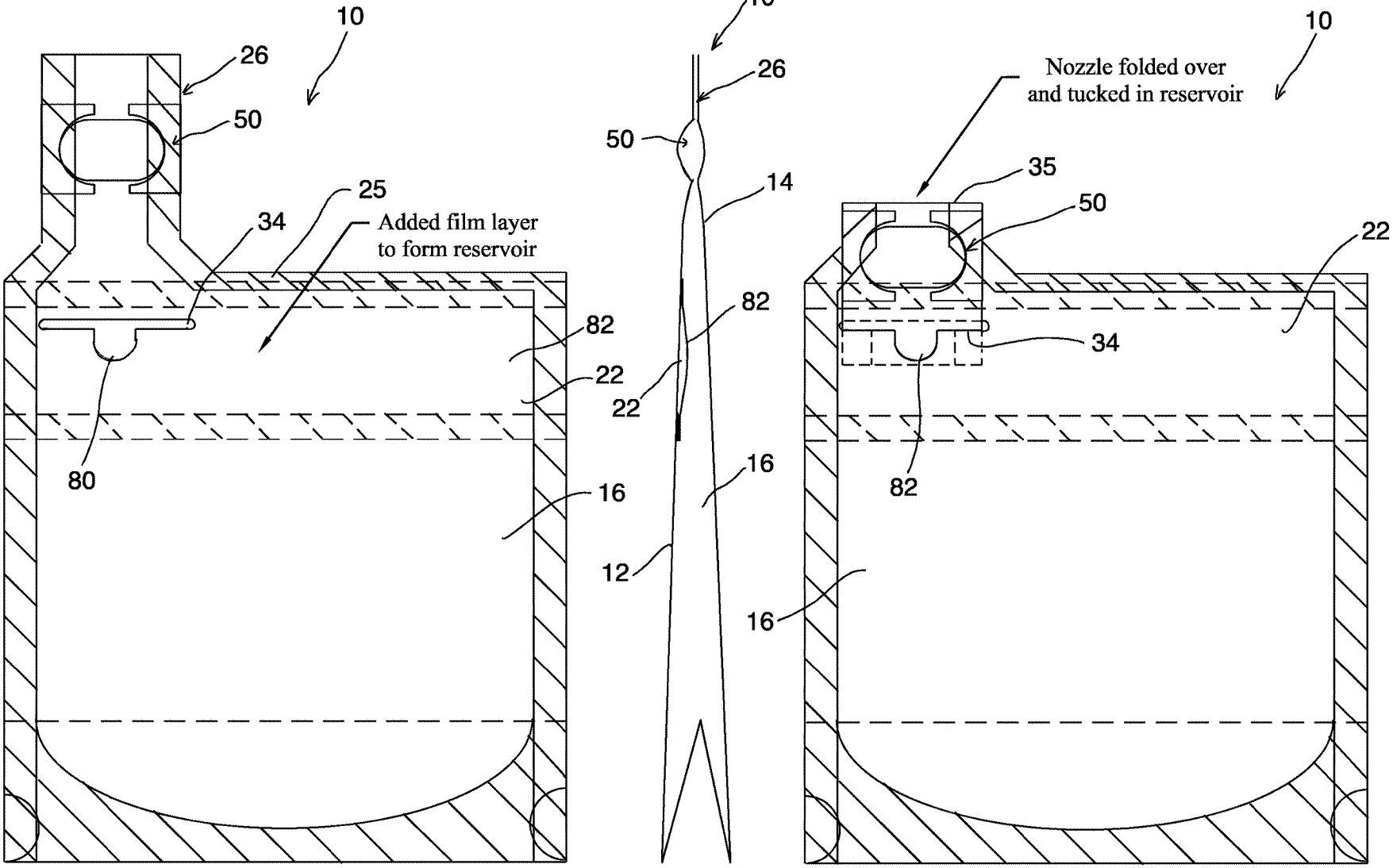
FIG. 13*a* shows a package having a pliable spout feature extending from a top seam without a seal and a spout retaining feature, with a tab, in accordance with embodiments of the present invention.
FIG. 13*b* shows a cross section view of FIG. 13*a*, in accordance with embodiments of the present invention.
FIG. 13*c* shows a package having a pliable spout feature operatively coupled to a spout retaining feature having a tab, in accordance with embodiments of the present invention.

In another example embodiment, as illustrated in FIGS. 13*a*-13*c*, the spout portion 26 may extend from the top or upper seal or seam 25 of the packaging 10. As particularly illustrated in FIG. 13*b*, the reservoir or containment area 22 may be formed or created by adding one or more layers, webs or panels of material to the inner or outer surface of the front panel portion 12 or back panel portion 14. The reservoir 22 may extend along only a portion or the entire surface of the packaging 10 depending upon the desired amount of volume. As particularly illustrated in FIGS. 13*a* and 13*c*, the slit 34 may be disposed generally below the spout portion 26 such that when a user desires to save any unused portion of the packaging contents, the user may bend or fold the spout portion 26 and insert a free end of the spout portion 26 into the slit 34. Similar to the other embodiments, the folding or kinking of the spout portion 26 creates a fold 35 that resists the movement of the package 10 contents if pressure is applied to the package 10. This example embodiment may also include any valve types 50 operatively disposed in the spout portion 26 or the reservoir 22 as previously described herein. In yet other embodiments, the seal 34 and/or the containment area 22 can be integrated with the closure mechanisms (e.g., valve closure 50), or portions thereof, such that the end of the spout portion 26 can be tucked or otherwise disposed within or along the closure mechanism to facilitate the containment features disclosed herein.

Although the spout portion 26 has been described as extending from a seam of the packaging it is also contemplated that the spout portion 26 can be formed with or extend from any portion of any of the panels of the package 10. For example, the spout portion 26 may extend from the front panel portion 12, back panel portion 14, a bottom panel portion 18, or side panels.

The packages 10 formed by the present invention can include packages constructed, in whole or in part, of flexible, rigid, semi-rigid, or semi-flexible materials or panels. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

Various embodiments of final packages, recloseable devices, and formation methods detailed herein are envisioned for use with, and can incorporate aspects of, many known packages, systems, and methods, including those disclosed in U.S. Pat. Nos. 5,461,845, 5,782,733, 5,806,984, 5,902,047, 5,951,453, 5,954,433, 6,019,512, 6,820,391, 7,207,717, 8,613,547 and 7,883,268. Accordingly, the above-identified patent disclosures are fully incorporated herein by reference in their entirety.

Various figures and descriptions disclose features and accessories. However, it must be noted that these features are merely illustrative in nature and may be placed in varying locations and under varying configurations and shapes, and still be consistent with the present invention. Various regions of the package can include a handle portion, access devices (e.g., re-closeable zipper devices), and the like. In addition, the shape and configuration for the panel portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 10.

What is claimed is:

1. A content control package, comprising:

a first panel portion and a second panel portion at least provided to define an interior content cavity;

an elongated spout portion including an access opening and in fluid communication with the interior content cavity;

one or more longitudinal slit portions in the first panel portion and transverse to a bottom of the package; and a retention area including a reservoir cavity having an internal volume, wherein the internal volume is separated from the interior content cavity by a plurality of seals, sealing at least the first panel portion to the second panel portion, to provide an outer perimeter reservoir boundary having three or more seal margins preventing fluid communication between the reservoir cavity and the interior content cavity, wherein the first panel portion includes one or more slit openings defined by the one or more longitudinal slit portions, wherein the elongated spout portion is bendable along a bend line such that the bend line angles toward both the bottom of the package and toward a top of the package, and wherein the elongated spout portion bends to extend transverse from the bend line, aligns with the one or more longitudinal slit portions, and extends into the reservoir cavity via the one or more slit openings defined by the one or more longitudinal slit portions, such that fluid communication is established between at least a portion of the elongated spout portion and the internal volume of the reservoir cavity, and not the interior content cavity.

2. The package of claim 1 wherein the elongated spout portion includes a valve device.

3. The package of claim 1, further comprising a longitudinal gap defined in a portion of an intermediate seal of the package.

4. The package of claim 1, wherein a portion of the elongated spout portion includes at least one attachment member and the one or more longitudinal slit portions includes at least one receiving attachment member, such that the elongated spout portion is removably attachable to the at least one receiving attachment member.

5. The package of claim 4, wherein the at least one attachment member and the at least one receiving attachment member includes hook and loop fasteners.

6. The package of claim 4, wherein at least one of the at least one attachment member and the at least one receiving attachment member includes an adhesive.

7. The package of claim 1, wherein the one or more longitudinal slit portions include a tab feature.

8. The package of claim 1, wherein a portion of the elongated spout portion does not extend into the reservoir cavity.

9. A flexible package, comprising:

a first panel portion and a second panel portion at least provided to define an interior content cavity, wherein one or more longitudinal slit features are provided with the first panel portion transverse to a bottom portion of the package;

an elongated spout portion including an access opening and in fluid communication with the interior content cavity; and a reservoir area having an internal volume, wherein the internal volume is separated from the interior content cavity by a plurality of seals, sealing at least the first panel portion to the second panel portion, to provide an outer perimeter reservoir boundary having three or more seal margins preventing fluid communication between the reservoir area and the interior content cavity, with the first panel portion including one or more slit openings defined by the one or more longitudinal slit features, wherein the elongated spout portion is bendable along a bend line such that the bend line angles toward both the bottom portion and a top portion of the package, and the elongated spout portion bends to extend transverse from the bend line and alignably inserts into the one or more longitudinal slit features, via the one or more slit openings defined by the one or more longitudinal slit features, such that fluid communication is established between at least a portion of the elongated spout portion and the internal volume of the reservoir area, and not the interior content cavity.

10. The package of claim 8, wherein the elongated spout portion includes a valve device.

11. The package of claim 9, wherein the one or more longitudinal slit features includes a tab feature.

12. The package of claim 9, wherein the one or more longitudinal slit features includes one longitudinal slit.

13. The package of claim 9, wherein the one or more longitudinal slit features includes two or more longitudinal slits.

14. The package of claim 9, wherein the elongated spout portion includes a removable top seal.

15. The package of claim 9, wherein a longitudinal gap is defined in a portion of an intermediate seal of the package.

16. The package of claim 1, wherein the elongated spout portion includes at least one of a closure mechanism or an attachment device.

17. The package of claim 9, wherein the elongated spout portion includes at least one of a closure mechanism or an attachment device.

18. The package of claim 17, wherein a portion of the elongated spout portion includes at least one attachment member and the reservoir area or the one or more longitudinal slit features includes at least one receiving attachment member.

19. The package of claim 18, wherein the at least one attachment member and the at least one receiving attachment member includes hook and loop fasteners.

* * * * *